United States Patent [19]

Langford et al.

[11] Patent Number: 4,768,368

[45] Date of Patent: Sep. 6, 1988

[54] TOOL FOR AND METHOD OF MAKING HOLLOW ARTICLES

[75] Inventors: Edward A. Langford; Geoffrey A. Morden, both of Sutton Colofield, United Kingdom

[73] Assignee: PFD Limited, Birmingham, England

[21] Appl. No.: 44,504

[22] PCT Filed: Aug. 4, 1986

[86] PCT No.: PCT/GB86/00467

§ 371 Date: Mar. 27, 1987

§ 102(e) Date: Mar. 27, 1987

[87] PCT Pub. No.: WO87/01061

PCT Pub. Date: Feb. 26, 1987

[30] Foreign Application Priority Data

Aug. 17, 1985 [GB] United Kingdom ..... 8520641

[51] Int. Cl.[4] ..... B21K 1/76; B21J 5/12; F16D 3/22

[52] U.S. Cl. ..... 72/355; 72/353; 72/359

[58] Field of Search ..... 72/345, 353, 354, 355, 72/358, 359

[56] References Cited

U.S. PATENT DOCUMENTS

| | | | |
|---|---|---|---|
| 4,317,356 | 3/1982 | Stell | 72/355 |
| 4,406,146 | 9/1983 | Suzuki | 72/359 |

FOREIGN PATENT DOCUMENTS

| | | | |
|---|---|---|---|
| 0013545 | 7/1980 | European Pat. Off. | 72/358 |
| 0158883 | 10/1985 | European Pat. Off. . | |
| 59-297 | 1/1984 | Japan | 72/355 |
| 8401529 | 4/1984 | PCT Int'l Appl. . | |
| 8503655 | 8/1985 | PCT Int'l Appl. . | |
| 2132514 | 7/1984 | United Kingdom . | |

*Primary Examiner*—W. Donald Bray

*Attorney, Agent, or Firm*—Marshall, O'Toole, Gerstein, Murray & Bicknell

[57] ABSTRACT

A tool for the manufacture of the outer member of a cross groove type constant velocity ratio universal joint has two sets of first and second elements disposed circumferentially between one another about the axis of the tool with the elements having portions which interfit to define a surface whose shape corresponds to that required in the joint, the portions having formations which form the sets of grooves, and with the elements so shaped that portions of the first elements can be moved radially inwardly to disengage their formations from the grooves.

9 Claims, 5 Drawing Sheets

TOOL FOR AND METHOD OF MAKING HOLLOW ARTICLES

This invention relates to the manufacture of hollow articles. The invention has been developed for the manufacture of the outer member of a constant velocity ratio universal joint of the cross-groove type. Such a joint comprises an inner member and an outer member, the outer member having an internal cylindrical surface and the inner member an external cylindrical surface which surfaces have grooves formed therein. There are two sets of, preferably, helical grooves in each member, the grooves of the two sets being helices of opposite hand. For manufacturing simplicity, the grooves are usually straight and inclined to the rotational axis of the respective joint member, instead of the truly helical. Bells are engaged in the grooves and are held in a cage, and because of the crossed configuration of the grooves the balls are held in the bisector plane of the joint as the parts of the joint articulate, to give the joint constant velocity ratio (homokinetic) properties.

Although the invention has been developed for making outer members for such cross groove constant velocity joints, it is applicable more generally to the manufacture of articles of the type, hereinafter referred to as being of the type specified, having two sets of grooves in the internal surface thereof, the sets of grooves having longitudinal axes of symmetry (as hereinafter defined) which differ (as hereinafter defined). By the longitudinal axis of symmetry of a groove, we mean the imaginary line which is equally spaced from the edges of the groove and which lies in an imaginary surface forming a continuation of the surface of the bore of the article, containing said edges.

When we say that the longitudinal axes of symmetry are the same, we mean that the loci of points moving in synchronism from the one ends of said axes of symmetry to the other bear a fixed relation to one another. Conversely, when we say that the longitudinal axes differ we mean that the loci of such moving points do not lie in a fixed relation to one another thus, for example, the axes could be on helices of different hand but the same pitch, of the same hand and different pitch, or of different pitch and hand. Some of the axes could be straight and parallel to the rotational axis of the article, while others could be helical.

At present, in the manufacture of outer members for cross-groove constant velocity ratio universal joints, blanks are made by forging, extrusion or some other metal forming method and the grooves are then machined in the blank bores. Such machining operations are expensive in time and equipment, besides necessarily involving the removal of material. It would be convenient to be able to form the grooves in the bore without removal of metal or even to make them with imprecise grooves which would require less machining than at present. However, since the longitudinal axes of symmetry of the grooves differ as defined above, a one piece tool could not be removed from the bore after the grooves have been formed therearound.

A tool, and method, for manufacturing articles of the kind specified is disclosed in GB-A-No. 2132514, which enables the machining required in the finished article to be reduced. The tool comprises intercalated portions capable of being withdrawn successively from the finished article by movement of formations on the portions along the grooves formed thereby. However, such successive withdrawal of the tool portions from the article can require very high forces which is disadvantageous.

It is an object of one aspect of the present invention to provide an improved tool for making hollow articles of the type specified, and particularly for making outer members of cross groove constant velocity universal joints, whereby machining of the gooves can be reduced or eliminated.

According to one aspect of the invention there is provided a tool for use in the manufacture of a hollow article of the type specified, by forming the material of the article about the tool and subsequently withdrawing the tool, the tool comprising a plurality of elements disposed circumferentially about a tool axis (which when the tool is in use is coincident with the longitudinal axis of the bore in the aritcle, i.e. the rotational axis of a joint outer member), said elements having portions interfitting to define an external surface having a configuration corresponding to that required in said internal surface and with formations corresponding to and adapted to form said grooves, said elements comprising a set of first elements and a set of second elements interposed between them with said portions of the first elements having formations adapted to form the grooves of one set and said portions of the second elements having formations adapted to form the grooves of a second set, with said first elements when in operative positions at least partially supporting said second elements in their respective operative positions, the arrangement being such that said portions of said first elements can be moved radially inwardly from their operative positions, to disengage said formations thereof from said grooves and to cease said support of said second elements, whereafter said tool can be removed from the article by movement of said formations of said second elements lengthwise of said grooves formed thereby.

Such removal of the tool from the article will be performed by a helical movement of the tool relative to the article, assuming the grooves formed by the formations of the second elements are helically inclined.

To enable said portions of the first elements to move radially inwardly between the said portions of second elements as part of the removal of the tool from the article, each of said portions of the first elements preferably has side surfaces which contact the adjacent second elements on opposite sides thereof to provide said at least partial support of the second elements, which side surfaces are convergent towards the external surface of the tool.

Thus, when the first element portions have been moved radially inwardly and disengaged from the grooves formed thereby, there is sufficient space provided for the second element portions to move to the small extent necessary for them to be freed from the tight engagement they have with the article and grooves therein by virtue of the forming process in which the material of the blank has been caused to conform to the configuration of the external surface of the tool.. It is well known that in such a forming process, there is the tendency for the formed material to stick to the tool, and the slight freedom afforded to the portions of the second elements to move radially, and thus be freed from such sticking, facilitates withdrawal of the tool from the formed article.

Said portions of the elements of the tool preferably define an internal cavity into which an expander member is movable axially to hold said elements in their operative positions, the expander member being withdrawn from said cavity to permit said portions of the first elements to be moved radially inwardly as a first step in the procedure for withdrawing the tool from the formed article. The second elements also may be engaged by the expander member when in their operative positions, in addition to their engagement by said side surfaces of the first elements.

The invention also provides a press fitted with a tool according to the invention as above set forth, and further comprising a die through which a hollow blank having the tool inside it can be pressed to form the article.

The invention further provides a method of manufacturing an article of the kind specified, by use of a tool according to the invention as above set forth.

The invention will now be described by way of example with reference to the accompanying drawings, of which:

Figure 1:
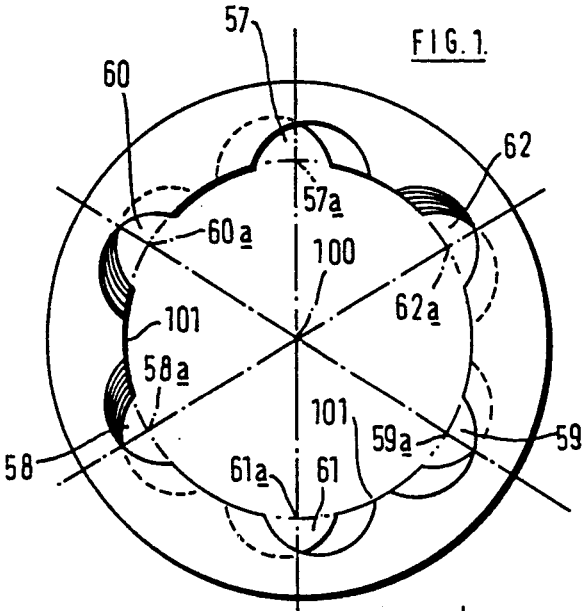
FIG. 1 is an end view of an outer member of a cross-groove constant velocity ratio universal joint.
Figure 2:
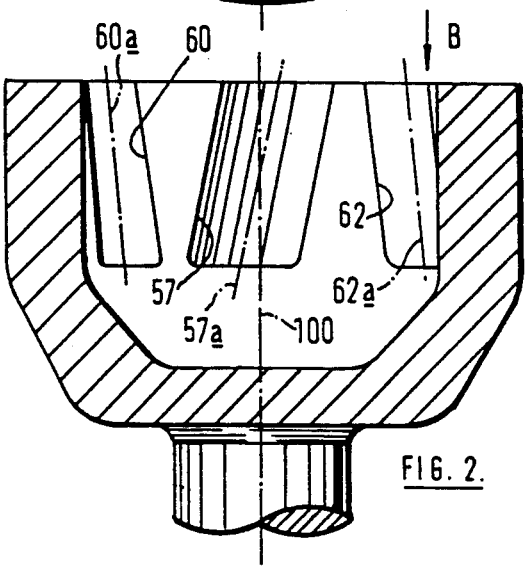
FIG. 2 is a section through the joint outer member of FIG. 1.

Referring firstly to FIGS. 1 and 2, these show the outer member of a cross groove constant velocity ratio universal joint, which is a hollow article with a cylindrical internal bore having a number of grooves therein. The central axis of the cylindrical bore, which is the rotational axis of the joint member in use, is indicated at 100. The joint member contains two sets of three grooves each, the grooves being of arcuate cross sectional shape and having helical longitudinal axes of symmetry. One set of grooves is indicated at 57, 58, 59 and these grooves are inclined in an anticlockwise helical sense when considered from above the joint member. The other set of grooves 60, 61, 62 are inclined in a clockwise helical sense when considered from above the joint member. The longitudinal axis of symmetry of each of the grooves is indicated by the number of the groove with the suffix letter a, such axis of symmetry lying equidistant from the edges of the groove and on the imaginary cylinder indicated by line 101, the cylinder containing the bore of the joint member.

At present, in the manufacture of constant velocity joint outer members such as these, the grooves are machined in a blank. Because the grooves are inclined in opposite hands, if they were formed by a one piece tool during extrusion of the article the tool would not be able to be removed from the finished article. The present invention provides a tool which is capable of being removed from such a joint outer member.

Figure 3:
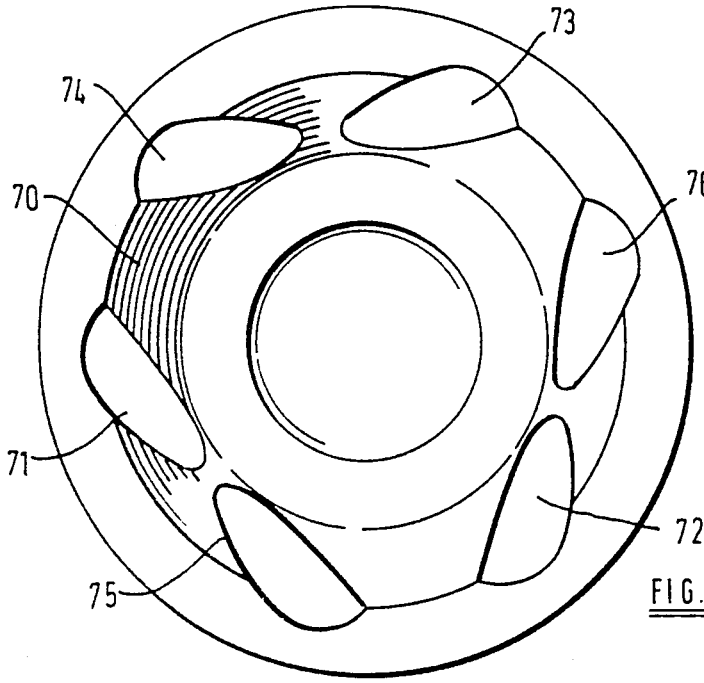
FIG. 3 is an end view of a blank to be used according to the invention in making the joint outer member.
Figure 4:
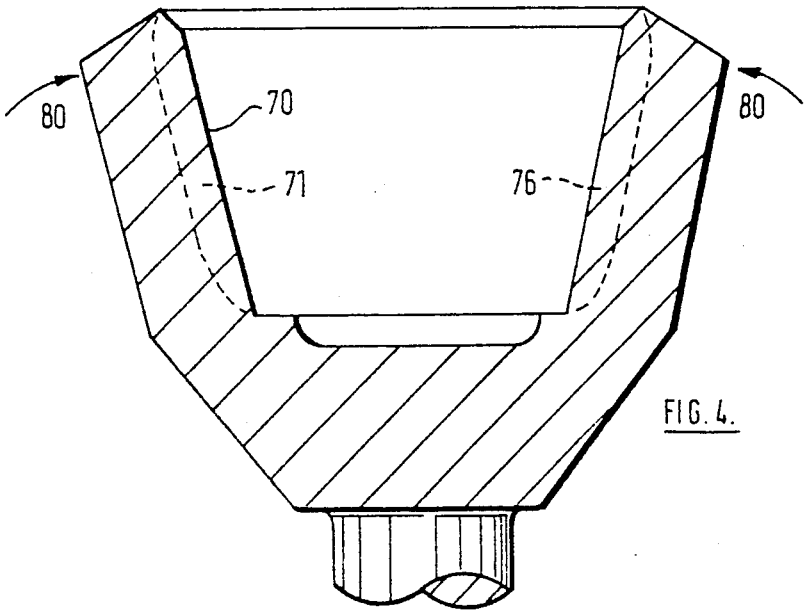
FIG. 4 is a section through the blank of FIG. 3.

Referring now to FIGS. 3 and 4 of the drawings, there is shown a configuration of blank which may with advantage by used with the tool to be described hereafter. It is cup shaped, with its internal and external walls diverging towards its free open end. The internal wall 70 is of generally frusto conical form, with two sets of oppositely inclined recesses therein. One set of recesses is indicated at 71, 72, 73, inclined in one direction, and the other set at 74, 75, 76 inclined in the opposite direction. These recesses, which are to form the grooves in the finished joint outer member, are of a configuration such that a one-piece forming tool can be withdrawn axially from the blank after the blank has been formed. Forming the blank to the finished joint outer member is achieved by inserting the tool to be described hereafter into the blank and forcing the blank through a die so as to deform the side wall of the blank inwardly as indicated by arrows 80 in FIG. 4.

Figure 5:
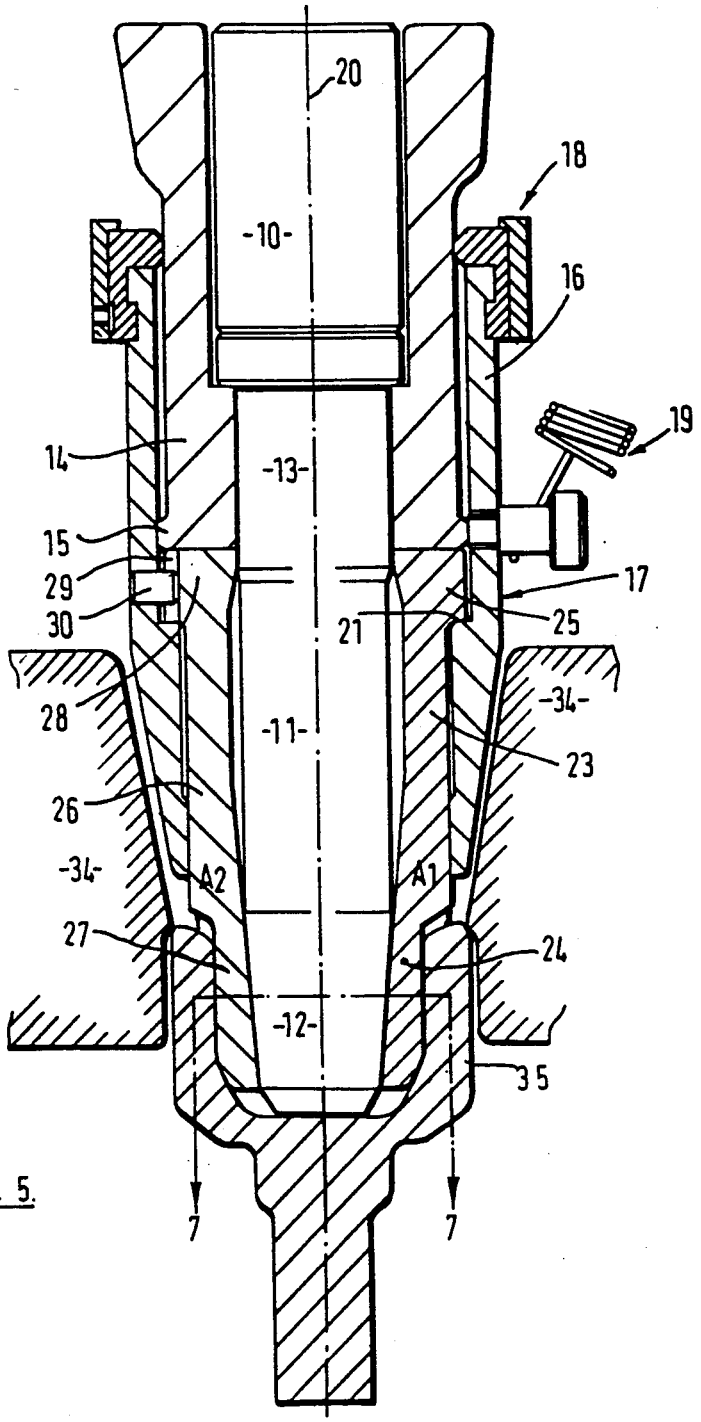
FIG. 5 is a section through a tool according to the invention, in a first stage of operation.

Referring now to FIG. 5 of the drawings, the ram of a press is indicated generally at 10. This has secured the it a downwardly extending expander member in the form of a mandrel 11, which has at its lower end a frustoconical nose portion 12 and at its upper end a cylindrical portion 13 of slightly greater diameter than the centre part of the mandrel. The ram 10 and the upper part 13 of the mandel are surrounded by a hollow body 14 with a radially outwardly extending flange 15 at its lower end. A part 16 of a sleeve 17 extends upwardly around the body 14, and carries at its uppermost end a retaining collar assembly 18 which is co-operable with flange 15 to limit the downward movement of sleeve 17 relative to the body 14. Tension springs, of which one is illustrated at 19, and of which the other ends are connected to a suitable part of the press, bias the sleeve 17 upwardly.

As well as being movable vertically relative to the body 14, the sleeve 17 is movable angularly thereabout, about an axis 20 which is the central axis of the tool (and the rotational axis of the joint outer member formed thereby), as well as the axis of movement of the ram 10 of the press. Internally, the sleeve is provided with an annular abutment surface 21, and, adjacent its lowermost end, a cylindrical internal constraining surface 22.

The tool further comprises six elements disposed circumferentially about the axis 20. These elements comprise a first set of elements A1, which are identical to one another and, interposed between them, a second set of elements A2 which are identical to one another but different from the elements A1. Each of the elements A1 comprises an elongate body part 23 having a portion 24 at its lowermost end and a head portion 25 at its upper end. The head portion 25 is engageable with abutment surface 21 inside the sleeve 17. Each of the elements A2 comprises a body portion 26 with a portion 27 at its lower most end and a head portion 28 at its uppermost end, also engageable with abutment surface 21 inside the sleeve 17. Each of the head portions 28 of an element A2 has a slot 29 which is engaged a peg 30 fitted to the sleeve 17, whose purpose will be described hereafter.

Figure 7:
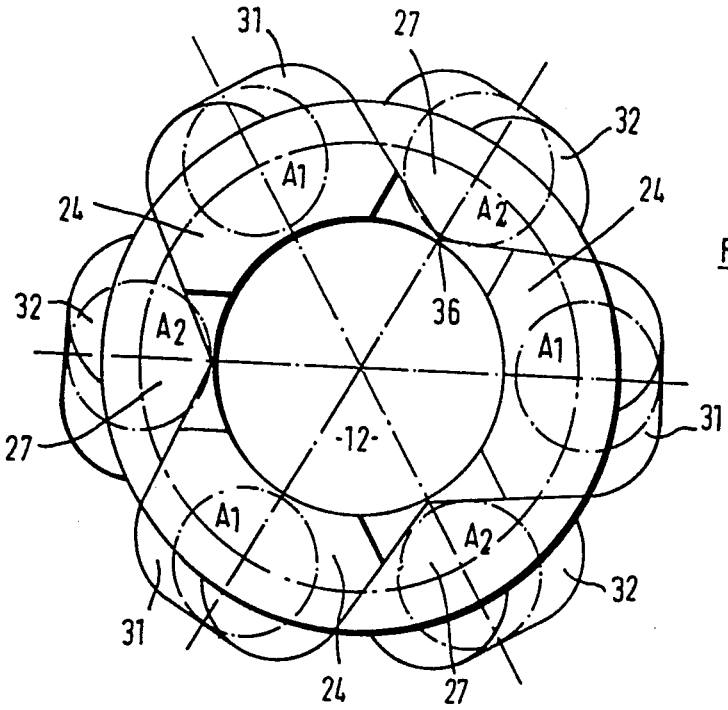
FIGS. 7 & 8 are sections respectively on the lines 7—7 and 8—8, through the tool in the two stages of operation thereof.
Figure 8:
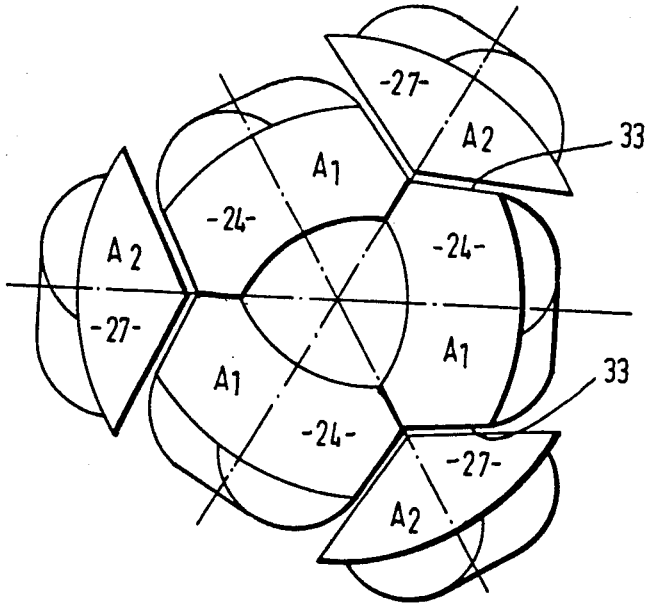

The shape of the portions 24, 27 of elements A1, A2 is seen most clearly with reference to FIGS. 7 and 8 of the drawings. The portions 24 of elements A1 have respective formations 31 thereon, which correspond to grooves inclined in one helical sense, to be formed within a joint outer member. Portions 27 of elements A2 have formations 32 thereon, to form grooves inclined in the opposite helical sense in a joint member. The portions 24 of the elements A1 have side surfaces as 33, which are convergent towards the external surface of the tool (considered as a whole), to enable the elements A1 to be pivoted about their head portions 25 such that portions 24 move radially inwardly and outwardly, between the positions shown in FIG. 7 and FIG. 8. FIG. 7 represents the operative position of the elements A1, A2, wherein the side surfaces 33 of portions 24 of elements a1 abut and support corresponding surfaces of portions 27 of elements A2. Portions 24 have internal part-frustoconical surfaces engageable with part 12 of mandrel 11, to maintain the elements in such a condition, and at the same time the body parts 23, 26 of elements A1, A2 engage the internal cylindrical constraining surface 22 of the sleeve 17 so that the elements are firmly maintained in relative positions in which their portions 24, 27 define a complete external surface corresponding to the internal surface required in the finished joint outward member. The head portions 25, 28 of the elements engage the cylindrical surface of portion 13 of the mandrel 11. The mandrel part 12 also engages the elements A2 as indicated at 36 in FIG. 7, so that support of these elements is not dependent solely on contact with elements A1.

In the condition illustrated in FIG. 8 of the drawings, part 12 of mandrel 11 has been withdrawn from the parts 24, 27 of the elements A1, A2 permitting the portions 24 of elements A1 to move radially inwardly as above described. In this condition, because of the outward convergence of side surfaces 33 of portions 24 of elements A1, there exists a clearance which enables some small radial movement of the portions 27 of elements A2.

The manner of operation of the tool above set forth will now be described.

Initially, the relative positions of elements A1, A2, sleeve 17, and mandrel 11 are as shown in FIGS. 5 and 7. That is, portions 24, 27 of the elements interfit as in FIG. 7 to define a substantially complete (i.e. with no or substantially no gaps into which the material of the blank may extrude) external surface corresponding to the required internal surface shape in a finished joint outer member. The tool can then be introduced into a blank of the type shown in FIGS. 3 and 4 of the drawings, and used to push the blank through a die (shown diagramatically at 34 in FIGS. 5 and 6) to cause the side wall of the blank to deform as indicated by arrows 80 in FIG. 4. The blank thus deformed, ie the finished joint outer member, is shown diagramatically at 35 in heavy outline in FIGS. 5 and 6. It is then necessary to withdraw the tool from the article 35.

Figure 6:
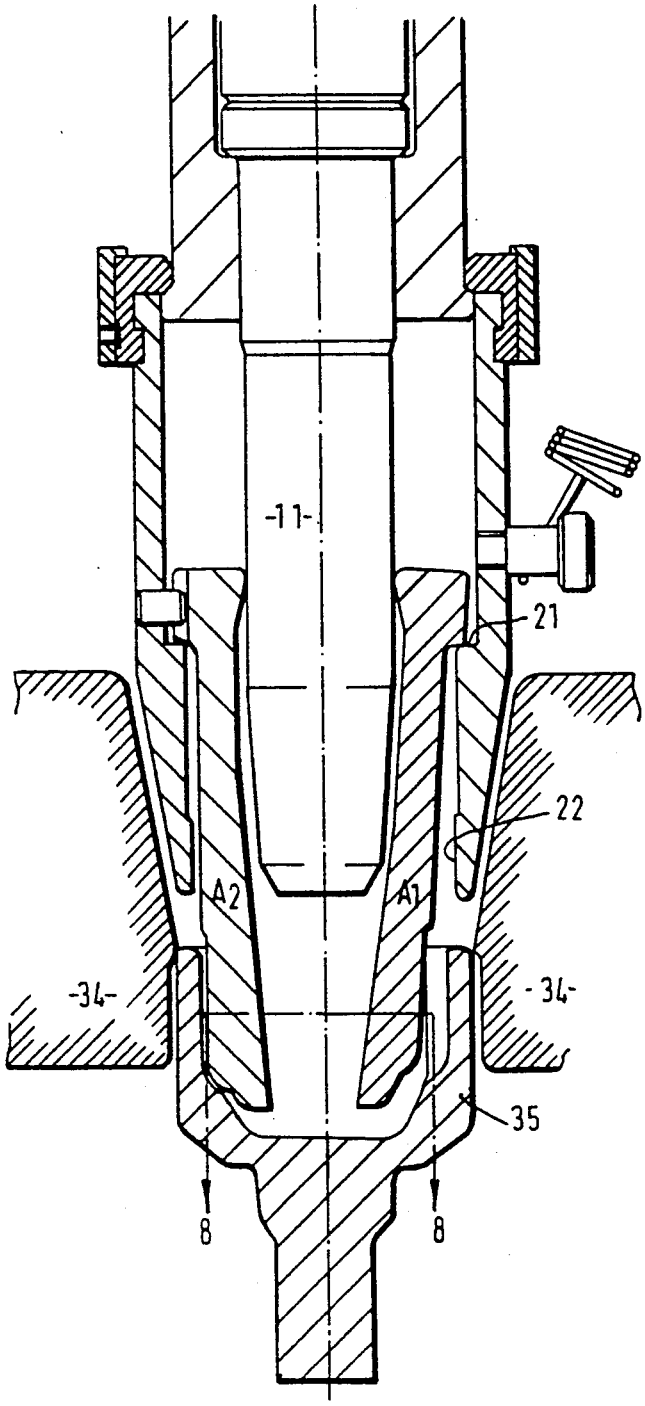
FIG. 6 is a section as FIG. 5, in a subsequent stage of operation.

As the ram 10 of the press is raised, mandrel 11 is raised therewith until its portion 12 is removed from the cavity defined by portions 24, 27 of elements A1, A2. The assembly of elements cannot withdraw from the article because of the opposite helical inclination of the grooves formed by the formations 31, 32, and thus the body 14 moves upwardly relative to sleeve 17 until flange 15 abuts retaining collar assembly 18. This conditions is shown in FIG. 6 of the drawings. Elements A1 are now free to pivot about their head portions 25 so that their portions 24 move radially inwardly and their formations 31 are disengaged from the grooves formed thereby. Such movement of elements A1 occurs as sleeve 17 is pulled upwardly by body 14, the forces acting on the parts of the tool being such as to cause the radially inward movement of portions 24 until portions 24 abut one another as shown in FIG. 8. This in turn gives clearance for the elements A2 to pivot slightly about their head portions 28 so that their portions 27 can move radially inwardly to a small extent to free them from the article but not fully to disengage them from the grooves therein. The elements A1, A2 can now be totally withdrawn from the finished article, with the formations 32 of elements A2 moving lengthwise of the grooves formed thereby. It will be appreciated that this is a helical movement, and sleeve 17 moves angularly about the axis 20 to permit this. Pegs 13 engaging with elements A2 prevent the latter from becoming misaligned during such withdrawal of the elements. After such withdrawal, springs 19 return the elements A1, A2 and sleeve 17 to their initial positions as represented by FIG. 6, ready for another operation.

The invention this provides a relatively simple and robust tool for making an article of the kind specified. The nature of the tool is such that little or no further machining may be required in the article produced thereby.

It will be appreciated that the principle of the invention may be applied to the formation of articles of the kind specified other than the universal joint outer member described. Particularly, it is applicable to articles with greater or lesser numbers of grooves from those above described, and the tool may comprise a greater or lesser number of interfitting elements as A1, A2.

We claim:

1. A tool for use in the manufacture of a hollow article by forming the material of the article about the tool and subsequently withdrawing the tool from the article, the article having an internal bore with a longitudinal axis and a bore surface with two sets of grooves therein, the sets of grooves having longitudinal axes of symmetry which differ from one another; the tool comprising:

a set of first elements;

a set of second elements;

means supporting said first and second elements in circumferential disposition about a tool axis, said second elements being interposed between said first elements;

said first and second elements having portions which interfit to define an external surface having a configuration corresponding to that required in said internal bore surface of the article, said portions further having formations corresponding to and adapted to form said grooves;

said formations of said said portions of the first elements being adapted to form the grooves of one set and said formations of said portions of the second elements being adapted to form the grooves of the second set thereof;

said first elements having support means for at least partially supporting said second elements in operative positions;

means permitting said portions of said first element to be moved radially inwardly from operative positions to disengage said formations thereof from said grooves; and means permitting said elements to be moved lengthwise of and angularly about said tool axis, for movement of said formations of said second elements lengthwise of the grooves formed thereby.

2. A tool according to claim 1 wherein each of said portions of the first elements has side surfaces which contact the adjacent second element portions on opposite sides thereof to provide said at least partial support of the second elements, said side surfaces being convergent towards the external surface of the tool.

3. A tool according to claim 1 wherein said portions of the elements of the tool define an internal cavity, and further comprising an expander member and means for moving said expander member axially into said internal cavity for holding said elements in their operative positions, and for withdrawing said expander member from said cavity for permitting said portions of the first elements to be moved radially inwardly.

4. A tool according to claim 2 wherein said second elements are also engaged by the expander member when in their operative positions.

5. A tool according to claim 2 further comprising a sleeve surrounding said elements, said sleeve including an inwardly facing surface with which parts of said elements engage to define the operative position thereof when the expander member occupies said cavity.

6. A tool according to claim 5 wherein said sleeve includes an abutment surface engaging said elements for withdrawing them from the article.

7. A tool according to claim 5 wherein said sleeve is movable angularly about said axis, and axially therealong, relative to the expander member.

8. A press fitted with a tool according to claim 1 and further comprising a die through which a hollow blank having the tool inside it can be pressed to form the article.

9. A method of manufacturing a hollow article, the article having an internal bore with a longitudinal axis and a bore surface with two sets of grooves therein, the sets of grooves having longitudinal axes of symmetry which differ from one another; comprising:

providing a hollow blank;

introducing into said hollow blank a tool comprising a set of first elements; a set of second elements; means supporting said first and second elements in circumferential disposition about a tool axis, said second elements being interposed between said first elements; said first and second elements having portions which interfit to define an external surface having a configuration corresponding to that required in said internal bore surface of the article, said portions further having formations corresponding to and adapted to form said grooves; said formations of said said portions of the first elements being adapted to form the grooves of one set and said formations of said portions of the second elements being adapted to form the grooves of the second set thereof; said first elements having support means for at least partially supporting said second elements in operative positions; means permitting said portions of said first element to be moved radially inwardly from operative positions to disengage said formations thereof from said grooves; and means permitting said elements to be moved lengthwise of and angularly about said tool axis, for movement of said formations of said second elements lengthwise of the grooves formed thereby;

deforming the blank to cause it to acquire an internal bore configuration corresponding to the configuration of said external surface of said portions of said elements of the tool with said tool axis coincident with said bore axis;

causing said portions of said fist elements to be moved radially iwnardly to disengage said formations thereof from said grooves formed thereby; and causing relative movement, both lengthwise of and angularly about said coincident axes, between said tool and said deformed blank, to withdraw the tool by movement of said formations of said second elements lengthwise of the grooves formed thereby.

* * * * *